US007063140B1

(12) United States Patent
Woo

(10) Patent No.: US 7,063,140 B1
(45) Date of Patent: Jun. 20, 2006

(54) MULTIPLE CLIMATE AIR SYSTEM

(76) Inventor: Ryan Woo, 5721 W. Mariposa Grande La., Glendale, AZ (US) 85310

( * ) Notice: Subject to any disclaimer, the term of this patent is extended or adjusted under 35 U.S.C. 154(b) by 0 days.

(21) Appl. No.: 10/957,959

(22) Filed: Oct. 4, 2004

(51) Int. Cl.
*F25B 29/00* (2006.01)
*F24F 13/00* (2006.01)
*F24F 3/044* (2006.01)

(52) U.S. Cl. ..... 165/209; 165/208; 165/217; 236/49.3; 236/1 B; 236/1 C; 236/51

(58) Field of Classification Search ..... 165/208, 165/209, 217; 236/49.3, 1 B, 1 C, 51
See application file for complete search history.

(56) References Cited

U.S. PATENT DOCUMENTS

| | | | | |
|---|---|---|---|---|
| 1,014,058 A | | 1/1912 | Goldberg | |
| 2,812,141 A | | 11/1957 | Sueda et al. | |
| 3,665,278 A | * | 5/1972 | Kazmarek | 318/466 |
| 4,316,256 A | | 2/1982 | Hendricks et al. | |
| 4,417,687 A | * | 11/1983 | Grant | 236/9 A |
| 4,452,391 A | | 6/1984 | Chow | |
| 4,506,829 A | * | 3/1985 | Grant | 236/49.3 |
| 4,914,368 A | * | 4/1990 | Orton | 318/663 |
| 4,931,948 A | * | 6/1990 | Parker et al. | 165/217 |
| 5,312,298 A | | 5/1994 | Myers | |
| 5,348,078 A | * | 9/1994 | Dushane et al. | 165/217 |
| 5,588,591 A | | 12/1996 | Sweitzer, Jr. | |
| 6,338,677 B1 | | 1/2002 | White | |
| 2002/0081963 A1 | | 6/2002 | Wasson | |

FOREIGN PATENT DOCUMENTS

| | | |
|---|---|---|
| GB | 1.394.751 | 5/1975 |
| WO | WO98/26225 | 6/1998 |

OTHER PUBLICATIONS

Key Systems for Commercial Buildings, Catalog # 523-301, Form 33CDS-1PD, Carrier Corporation, 1986.*

* cited by examiner

*Primary Examiner*—John K. Ford
(74) *Attorney, Agent, or Firm*—Michael I. Kroll

(57) ABSTRACT

The present invention 10 discloses a climate control system for a dwelling 12 comprised of main air conditioning unit 36 and a plurality of thermostats 14 and vents 16. Each of the thermostats 14 is positioned within a zone 18 which can be a single room, controlling one or more vents 16 within the zone. In the preferred embodiment, a thermostat 14 is positioned within a room 18 controlling the opening and closing of the vent(s) 16. Once the desired room temperature is reached the thermostat 14 will close the vent 16. The air conditioner 36 will continue to operate as long as one thermostat 14 setting has not been cooled to the desired temperature. Once the desired temperature is reached, the main air conditioner 36 will turn off and all vents 16 will open until the temperatures of all of the area involved in the system begin to drop or rise and the central air will then turn on again.

6 Claims, 7 Drawing Sheets

MULTIPLE CLIMATE AIR SYSTEM

BACKGROUND OF THE INVENTION

1. Field of the Invention

The present invention relates generally to air systems and, more specifically, to a climate control system for a dwelling comprised of an air conditioning unit and a plurality of thermostats and vents. Each of the thermostats is positioned within a zone, which can be a single room, controlling one or more vents within the zone. In the preferred embodiment, a thermostat is positioned within a room controlling the opening and closing of the vent(s). Once the desired room temperature is reached the thermostat will close the vent. The air conditioner will continue to operate as long as one thermostat setting has not been cooled or heated to the desired temperature. Once the desired temperature is reached, the air conditioner will turn off and all vents will open until the temperatures of all of the area involved in the system begin to drop or rise and the central air will then turn on again, repeating the process.

2. Description of the Prior Art

There are other climate control systems designed for the same purpose. Typical of these is U.S. Pat. No. 1,014,058 issued to Goldberg on Jan. 9, 1912.

Another patent was issued to Sueda et al. on Nov. 5, 1957 as U.S. Pat. No. 2,812,141. Yet another U.S. Pat. No. 4,316,256 was issued to Hendricks, et al. on Feb. 16, 1982 and still yet another was issued on Nov. 29, 1983 to Grant as U.S. Pat. No. 4,417,687.

Another patent was issued to Chow on Jun. 5, 1984 as U.S. Pat. No. 4,452,391. Yet another U.S. Pat. No. 5,312,298 was issued to Myers on May 17, 1994. Another was issued to Sweitzer on Dec. 31, 1996 as U.S. Pat. No. 5,588,591 and still yet another was issued on Jan. 15, 2002 to White U.S. Pat. No. 6,338,677.

Another patent was issued to Wasson on Jun. 27, 2002 as U.S. Patent No. 2002/0081963. Yet another WIPO Patent Publication No. 98/26225 was published by Sweitzer on Dec. 13, 1996. Another was issued to Hydroculture Incorporated on May 21, 1975 as U.K. Pat. No. 1,394,751.

U.S. Pat. No. 1,014,058

Inventor: Edward Goldberg

Issued: Jan. 9, 1912

A device comprising a casing adapted to fit within the upper portion of a window frame and extending outwardly therefrom, rotatable blades arranged in said casing and adapted to alternately open and close the outer portion of the casing, a shutter mechanism carried by the inner portion of the casing and common means for operating said blades and shutter.

U.S. Pat. No. 2,812,141

Inventor: Robert H. Sueda, et al.

Issued: Nov. 5, 1957

A vent control comprising an enclosure, a vent for said enclosure, means hingedly mounting said vent, an electric motor, means for opening and closing said vent upon turning said motor, and control means for said motor comprising an electric circuit for said motor, a thermostat, a control arm, means connecting said vent and said control arm to adjust the position of said control arm responsive to the position of said vent, a horizontal pivot for said control arm, a cable connecting said vent and said control arm to swing said control arm about said pivot as said vent moves, a mercury switch mounted on said control arm to open when said vent is open beyond a predetermined amount and closed when said vent is open less than said predetermined amount, and a limit switch mounted on said vent responsive to break the current to interrupt closing of said vent when said vent is in closed position and in which said cable includes wire for said limit switch.

U.S. Pat. No. 4,316,256

Inventor: Donald B. Hendricks, et al.

Issued: Feb. 16, 1982

A microcomputer controlled digital thermostat has separate, independent registers for storing heating control information and cooling control information. On a periodic basis, the microcomputer determines whether the furnace should be turned on, based upon a temperature signal indicative of room temperature, a time-of-day value indicative of the present time of day, and the stored heating control information. If the furnace is already off and the microcomputer determines that it should remain off, the microcomputer then determines whether air conditioning is needed, based upon the temperature signal, the time-of-day value, and the stored cooling control information.

U.S. Pat. No. 4.4170,687

Inventor: Willie T. Grant

Issued: Nov. 29, 1983

An automatically controlled multi-blade damper device for use in air registers installed over furnace duct boots terminating in recesses of floors, ceilings, or walls of dwellings; said boots being part of a central heating and/or air conditioning system. The several damper blades are attached to a gear train and pivotably mounted in a damper housing assembly; said blades being rotatable between open and closed positions by motor driven damper blade attached to gear means and motor means; said motor means, electrically connected to furnace control means and to individual room thermostat, cooperate to maintain the preferred temperature environment in subject room.

U.S. Pat. No. 4,452,391

Inventor: Vincent Y. S. Chow

Issued: Jun. 5, 1984

An automatic air regulating device for use in a forced air heating or cooling system whereby air vents or ducts leading to various rooms within a building may be automatically opened or closed to conserve energy. The automatic air regulating device of the present invention utilizes airfoil shaped dampers rotatable between open and closed positions within the building's air ducts. This airfoil shape thus provides for efficient and inexpensive operation of the dampers by utilizing the forced air flowing through the system for its operating forces. The dampers are further controlled by operation of restraining means which establish opening and closing conditions of the dampers in response to programmed or timed parameters set according to desired occupancy or use patterns within the building.

U.S. Pat. No. 5,312,298

Inventor: Leroy Myers

Issued: May 17, 1994

Floor vents for alternately supplying air to a conditioned space. Such vents, used in combination with a heating or cooling system, facilitate the delivery of air in a desired direction. The plastic vent may be constructed of pigmented material in a desired color. Louvers with integrally formed gears are pivotally mounted between ends of the vent, and are repositioned by a thumbwheel located below the upper surface of the grille portion of the vent, to thereby avoid damage to the gear by foot traffic above the vent. The louvers are provided with integrally formed bushings and rotatable end elements to enhance rotation and reliability.

U.S. Pat. No. 5,588,591

Inventor: Bruce K. Sweitzer, Jr.

Issued: Dec. 31, 1996

A heating system that allows independent control of the temperatures within different rooms in a building by independently controlling the flow of heating fluid to each room in response to a thermostat provided in each individual room. The output of the thermostat controls the operation of a three-way valve upstream of a radiator or convector in each room. When the room temperature is at or above the setpoint for that room, the valve operates to divert all heating fluid flow through a bypass pipe or shunt extending from the valve to the outlet of the radiator or convector. When the temperature drops below the setpoint, the valve operates to resume heating fluid flow through the radiator or convector while shutting off heating fluid flow through the bypass pipe. In another embodiment, independent control of room temperature in heated air distribution systems, is effected by thermostatically controlled louvers provided at the heated air register in each room. When the room temperature is at or above the setpoint for the particular room, the louvers shut off heated air flow to the room thereby preventing further heating of the room.

U.S. Pat. No. 6,338,677

Inventor: Samuel J. White

Issued: Jan. 15, 2002

A system for controlling the opening and closing of vents within a structure. The system includes a plurality of vents positioned around the structure and a control panel is centrally positioned in a readily accessible position within the structure. The vents each include a cover plate having a recess extending therethrough a plurality of louvers positioned in spaced parallel relationship within the recess and a device for automatically pivoting the plurality of louvers between an open position and closed position. The control panel includes a plurality of control buttons, each control button controlling pivoting a respective one of the plurality of louvers between the open and closed positions. A lever connects the plurality of louvers within each vent together causing the louvers to move together. The pivoting device for each vent includes first and second solenoids and a latch and spring device connected between both the first and second solenoids and the lever. The first and second solenoids are each controlled by a respective one of the control buttons to rotate causing the latch and spring device to exert a force on the lever such that the lever pivots the plurality of louvers into one of the open or closed positions. Each of the vents further includes a manually operated lever for moving the louvers between the open and closed positions.

U.S. Patent Publication No. 2002/0081963

Inventor: Walter L. Wasson

Issued: Jun. 27, 2002

Apparatus for removing excessive heat which has built up in a garage, including vents, movable louvers connected to each vent, exhaust fans, and exhaust motor. The fan motor may be controlled by a manually operated switch or a thermostat.

WIPO Publication Number WO 98/26225

Inventor: Bruce Sweitzer

Issued: Jun. 18, 1998

A heat dissipation sub-system comprising a heat dissipation unit having an inlet opening and a discharge opening, said heat dissipation unit being dimensioned and configured to allow heat transfer from a heating fluid flowing therethrough to air contained in a room, said discharge opening being in fluid communication with a discharge conduit.

United Kingdom Patent Number 1,394,751

Inventor: Hydroculture incorporated

Issued: May 21, 1975

An apparatus suitable for growing plants in a regulated climate inside an enclosure. The apparatus is particularly but not exclusively suitable for providing optimum growing conditions for hydroponic culture of plants.

While these cooling devices may be suitable for the purposes for which they were designed, they would not be as suitable for the purposes of the present invention, as hereinafter described. The present invention, a multi climate air system that allows multiple rooms to maintain different temperatures deriving from one air conditioning unit. The system comprises a motorized air vent in each room that cuts off the air from the room and a thermostat in each room to control the air temperature. Each room receives air until the temperature reaches a desired temperature, then the vent closes and this continues until all vents become closed. When all rooms have reached the desired temperature, air shuts off, and all vents are reopened until the temperatures of all of the area involved in the system begin to drop or rise and the central air will then turn on again, repeating the process.

SUMMARY OF THE PRESENT INVENTION

The present invention discloses a climate control system for a dwelling comprised of main air conditioning unit and a plurality of thermostats and vents. Each of the thermostats is positioned within a zone which can be a single room, controlling one or more vents within the zone. In the preferred embodiment, a thermostat is positioned within a room controlling the opening and closing of the vent(s). Once the desired room temperature is reached the thermostat will close the vent. The air conditioner will continue to operate as long as one thermostat setting has not been cooled or heated to the desired temperature. Once the desired temperature is reached, the main air conditioner will turn off and all vents will open until the temperatures of all of the area involved in the system begin to drop or rise and the central air will then turn on again, repeating the process.

A primary object of the present invention is to provide a multiple climate air system that allows multiple rooms to maintain different temperatures.

Another object of the present invention is to provide a multiple climate air system that allows multiple rooms to maintain different temperatures deriving from one air conditioning unit.

Yet another object of the present invention is to provide a multiple climate air system that comprises a motorized air vent in each room that cuts off the air from the room.

Still yet another object of the present invention is to provide a multiple climate air system that comprises a thermostat in each room to control the air temperature.

Another object of the present invention is to provide a multiple climate air system that each room receives air until the temperature reaches a desired temperature, then the vent closes and this continues until all vents become closed.

Yet another object of the present invention is to provide a multiple climate air system that when all rooms have reached the desired temperature, air shuts off, and all vents are reopened until the temperatures of all of the area involved in the system begin to drop or rise and the central air turns on again.

Additional objects of the present invention will appear as the description proceeds.

The present invention overcomes the shortcomings of the prior art by providing a multiple climate air system that allows multiple rooms to maintain different temperatures deriving from one air conditioning unit. The system comprises a motorized air vent in each room that cuts off the air from the room and a thermostat in each room to control the air temperature. Each room receives air until the temperature reaches a desired temperature, then the vent closes and this continues until all vents become closed. When all rooms have reached the desired temperature, air shuts off, and all vents are reopened until the temperatures of all of the area involved in the system begin to drop or rise and the central air will then turn on again, repeating the process.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
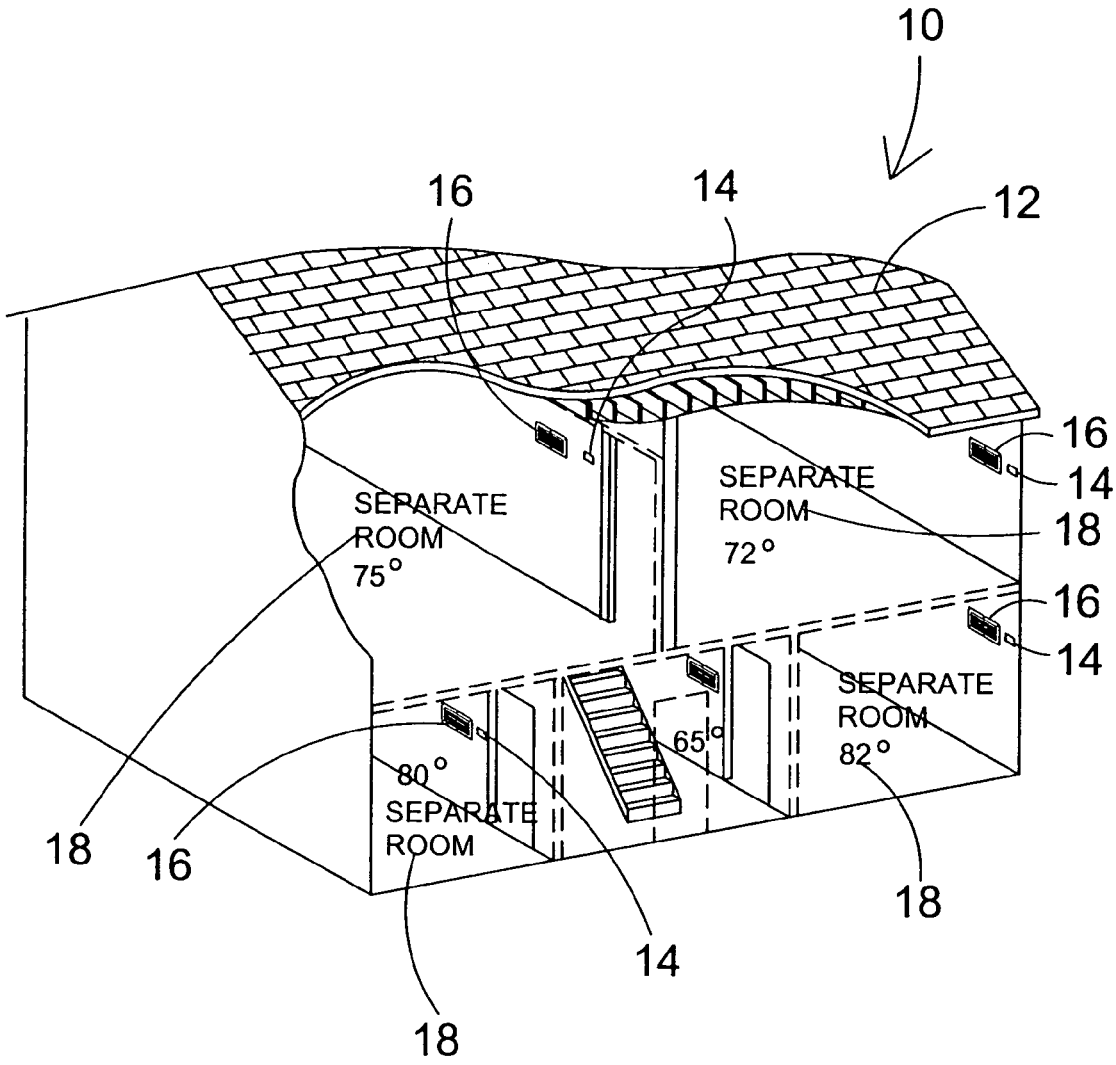
FIG. 1 is an illustrative view of the present invention in use.

With regard to reference numerals used, the following numbering is used throughout the drawings.

10 present invention
12 dwelling
14 thermostat
16 motorized vent
18 room/zone
20 motor
22 motor gear
24 drive gear
26 louver gear
28 louver
30 vent frame
32 louver frame
34 main thermostat
36 air unit
38 motorized flap
40 duct
42 fan
44 air vent (no motor)

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 is a climate control system for a dwelling 12 comprised of an air conditioning unit and a plurality of thermostats 14 and vents 16. Each of the thermostats 14 is positioned within a zone, which can be a single, separate room 18, controlling one or more vents 16 within the zone. In the preferred embodiment, a thermostat 14 is positioned within a room 18 controlling the opening and closing of the vent(s) 16. Once the desired room temperature is reached the thermostat 14 will close the vent 16. The air conditioner will continue to operate as long as one thermostat 14 setting has not been cooled to the desired temperature. Once the desired temperature is reached, the air conditioner will shut off and all vents 16 will be opened until the temperatures of all of the area involved in the system begin to drop or rise; i.e. reach the desired temperature, and the central air will then turn on again, repeating the process.

Figure 2:
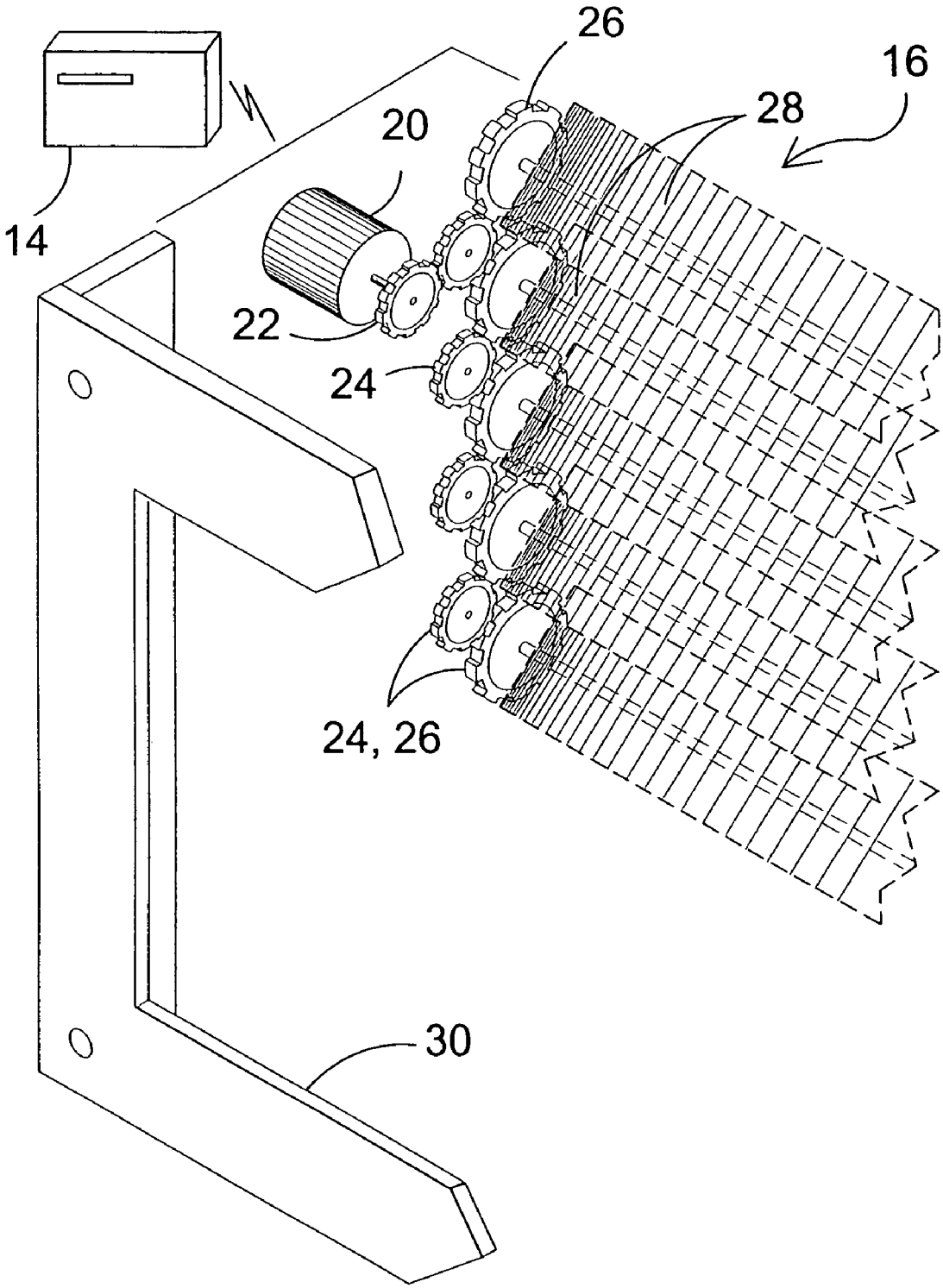
FIG. 2 is an exploded view of the motorized vent of the present invention.

Turning to FIG. 2, shown therein is an exploded view of the motorized vent 16 of the present invention. Shown is the motorized vent 16 of the present invention having a motor 20 in communication with the zone thermostat 14. The motor shaft has a gear 22 mounted thereon in engagement with a drive gear 24 engaging a gear 26 having a louver 28 attached thereto. A number of engaging drive gears 24 and louver gears 26 cause the louvers to open and close in concert. The vent frame 30 is also shown.

Figure 3:
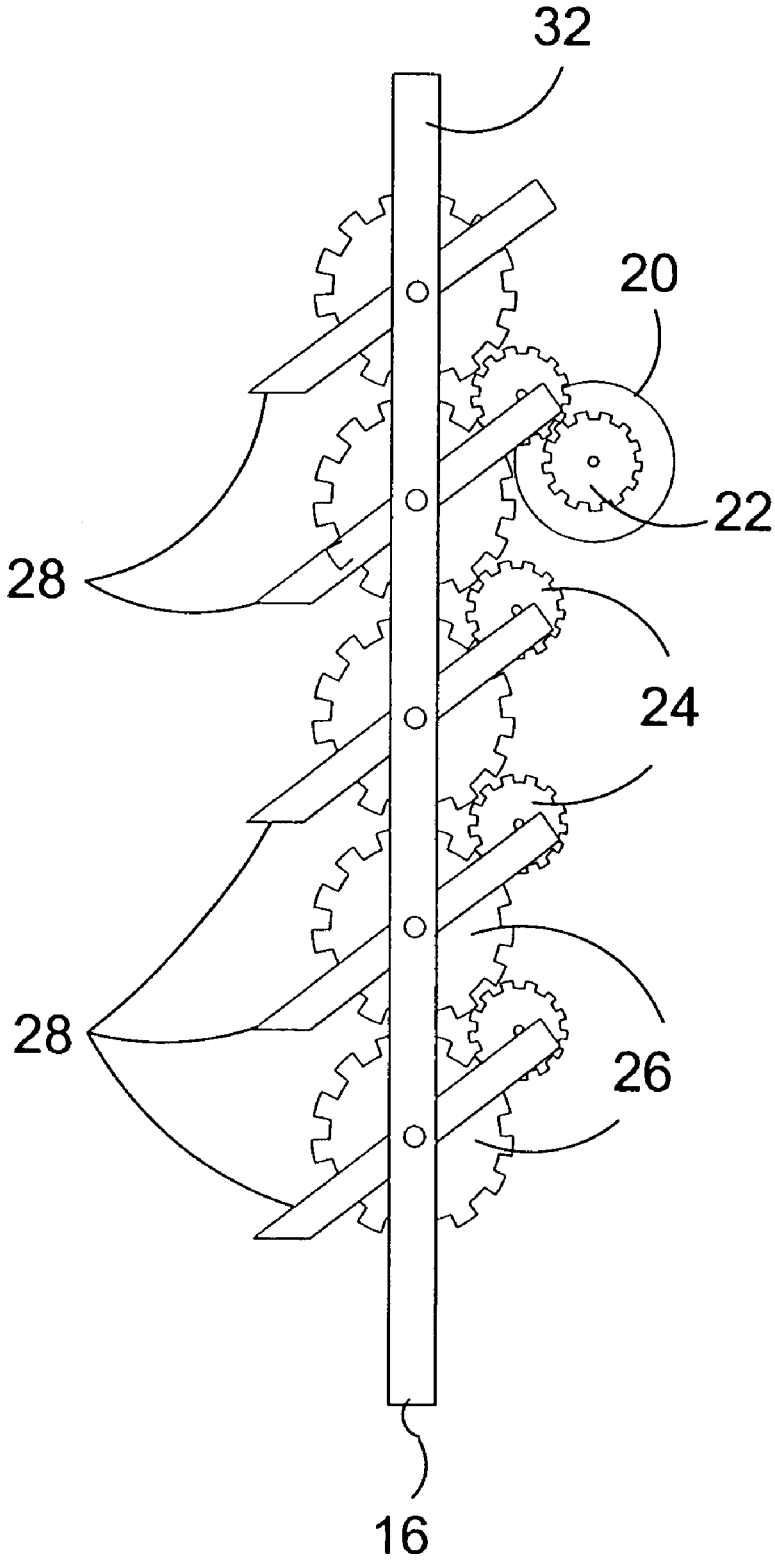
FIG. 3 is a side view of the motorized vent of the present invention.

Turning to FIG. 3, shown therein is a side view of the motorized vent 16 of the present invention. Shown is the motorized vent 16 of the present invention comprising a frame 30 having a plurality of louvers 28 mounted therein. Each of the louvers 28 has a gear 26 engaging a drive gear 24, with one or them engaging the motor gear 22, which drives all of the louvers in concert. The motor 20 is controlled by the zone thermostat. Once the zone has reached the user selected thermostat setting, the motor 20 is energized to close the louvers. When all of the zones have reached the desired temperatures, all of the vents are open and until the temperatures of all of the area involved in the system begin to drop or rise; i.e., reach the desired temperature, and the central air will then turn on again, repeating the process.

Figure 4:
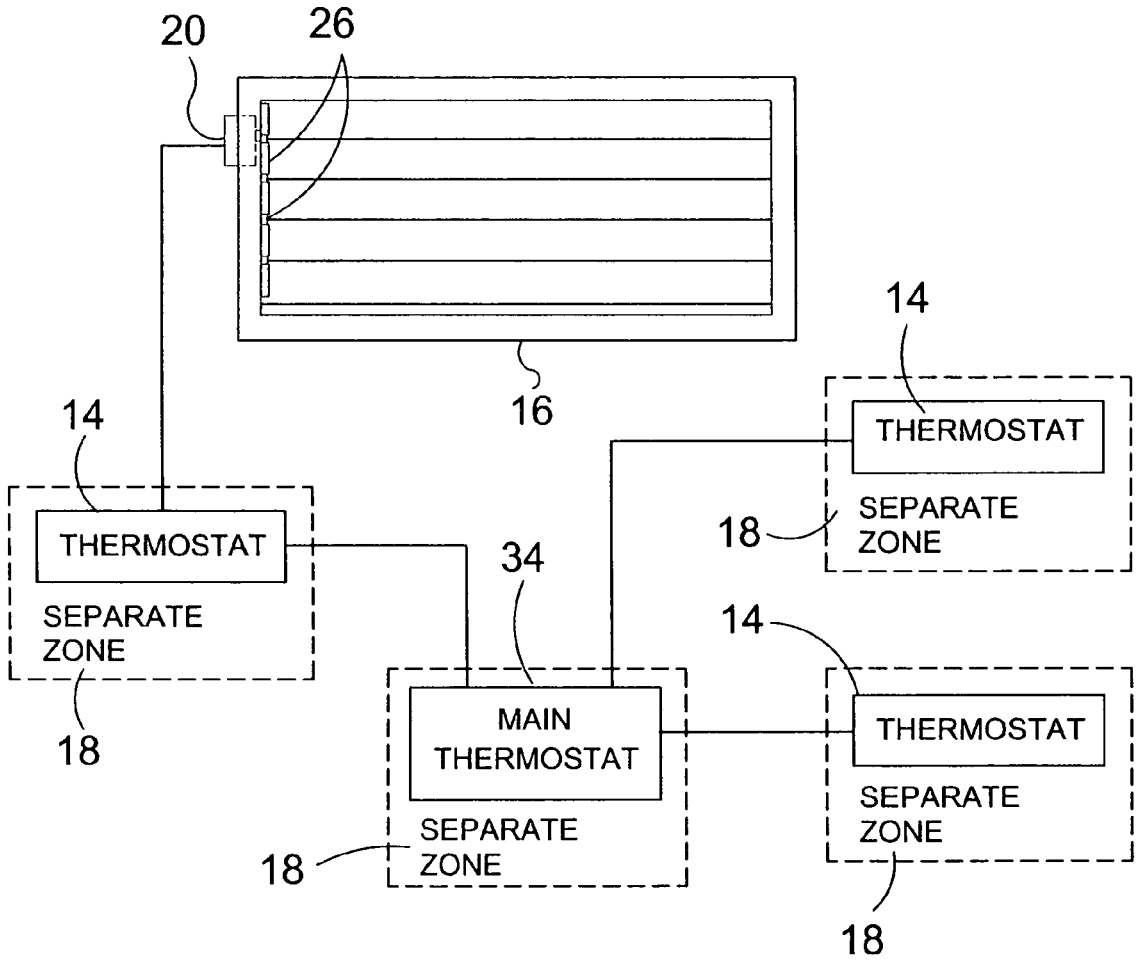
FIG. 4 is a diagrammatic view of the present invention.

Turning to FIG. 4, shown therein is a diagrammatic view of the present invention. This system allows a number of zones or rooms 18 to have separate air temperatures from one central unit. The system consists of at least one motorized vent 16 and thermostat 14 in each zone. The central air unit will have a main thermostat 34 and all of the zone thermostats 14 will be connected to the main. The system provides that each room or zone 18 will be selectively set to a desired thermostat 14 setting which will be communicated to the main thermostat 34. When the air conditioner is energized each independent thermostat 14 will close its respective vent 16 when the temperature is achieved until all rooms or zones 18 have achieved their desired temperature, whereupon the air conditioning unit will shut off and all vents will reopen until the temperatures of all of the area involved in the system begin to drop and the central air turns on again. The motor 20 and louver gears 26 are also shown.

Figure 5:
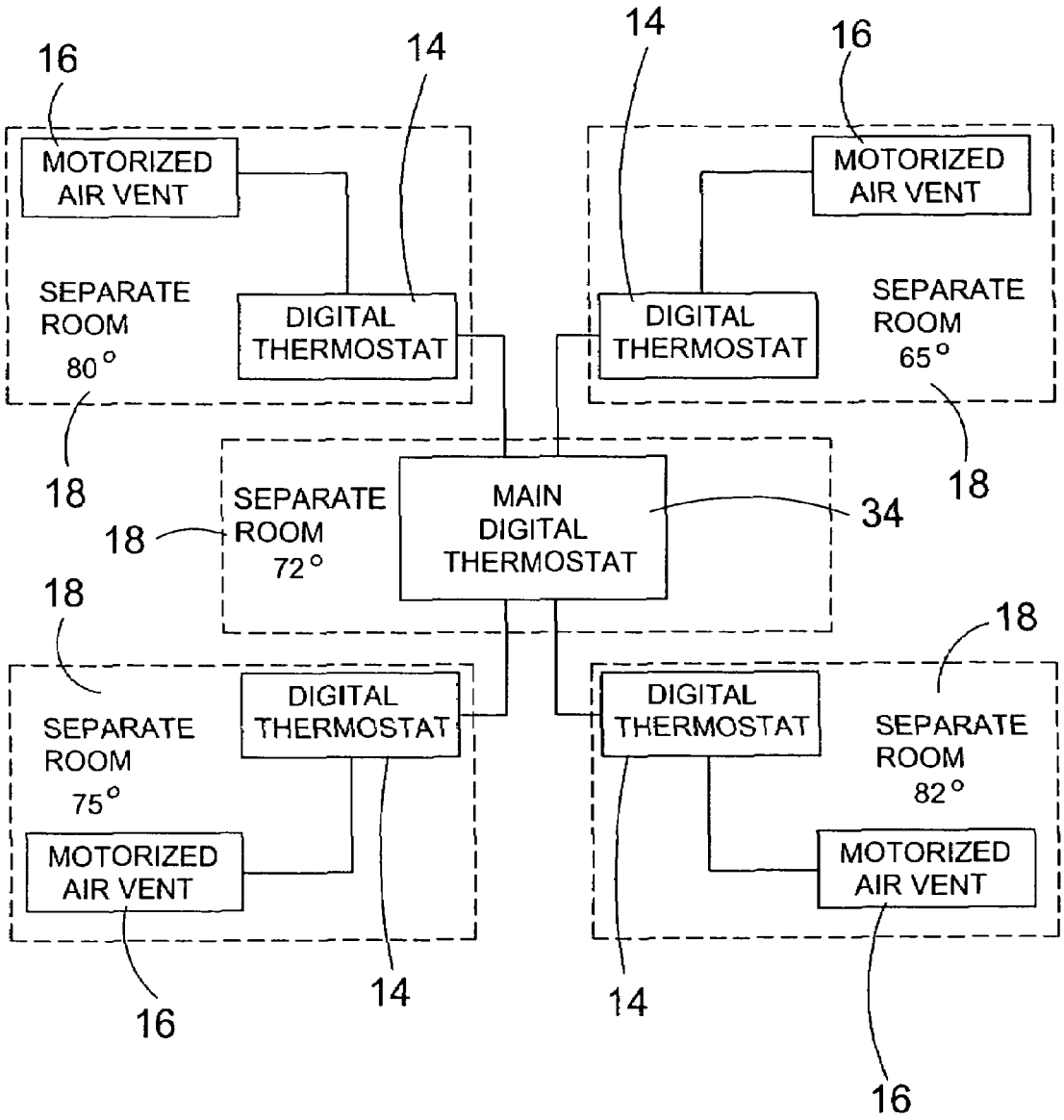
FIG. 5 is a diagrammatic view of the present invention.
Figure 6:
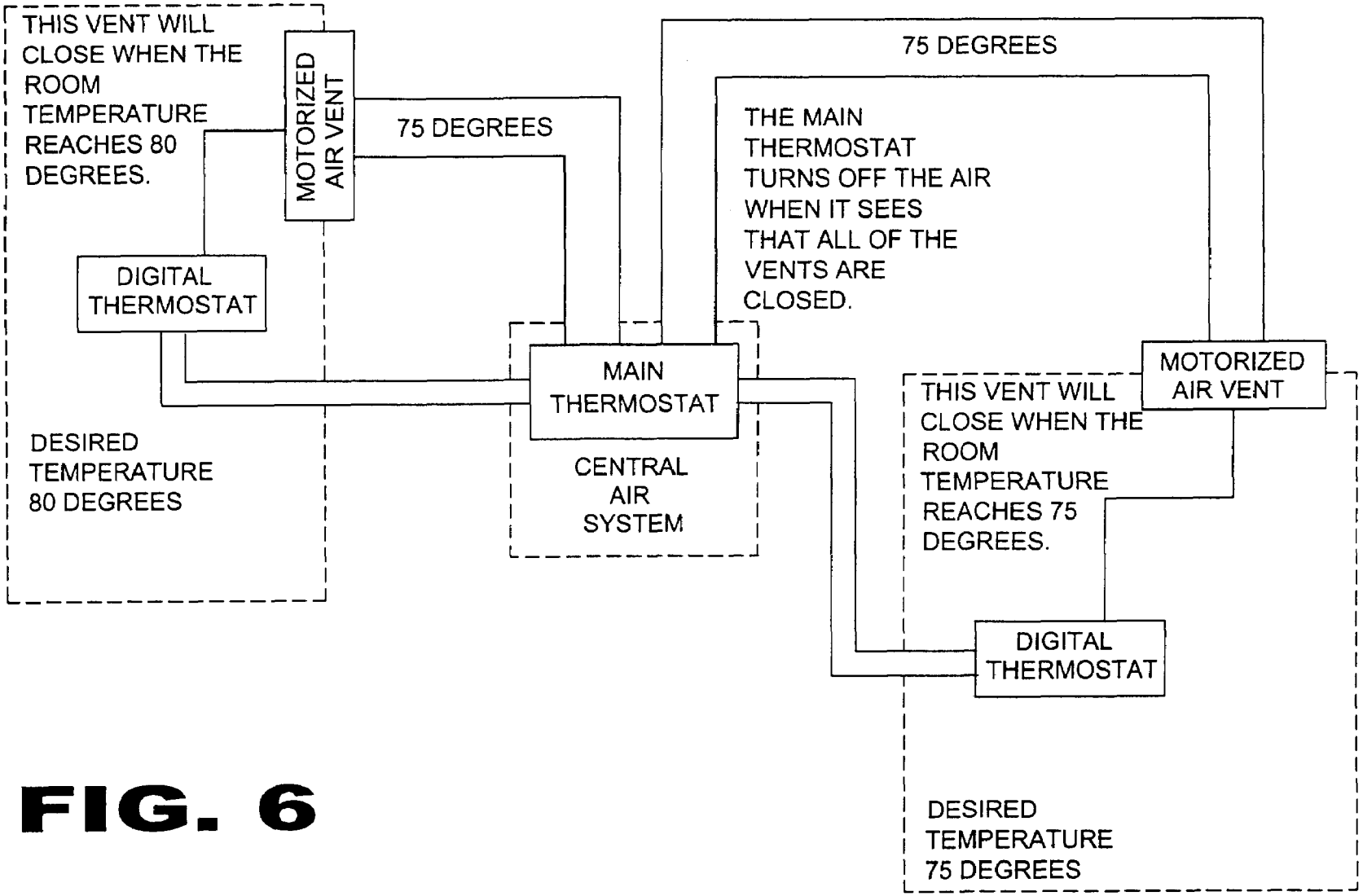
FIG. 6 is a flow chart of the functions of the present invention.

Turning to FIG. 5, shown therein is a diagrammatic view of the present invention. This system allows a number of zones or rooms 18 to have separate air temperatures from one central unit. The system consists of at least one motorized vent 16 and thermostat 14 in each zone. The central air unit will have a main thermostat 34 and all of the thermostats 14 will be connected to the main. The system provides that each room or zone 18 will be selectively set to a desired thermostat 14 setting which will be communicated to the main thermostat 34. When the air conditioner is energized each independent thermostat 14 will close its respective vent 16 when the temperature is achieved until all rooms or zones 18 have achieved their desired temperature, whereupon the air conditioning unit will shut off and all vents will reopen until the temperatures of all of the area involved in the system begin to drop or rise and the central air will then turn on again, repeating the process Turning to FIG. 6, shown therein is a flow chart of the functions of the present invention. When the air is turned on, the same air temperature will be sent to every room, this temperature will be the lowest temperature picked out of all the rooms. As the temperatures begin to fall or rise in the rooms once the desired temperature is reached, the vent for that room is shut. The rest of the rooms will still continue to receive air until the desired temperatures are reached until the temperatures of all of the area involved in the system begin to drop or rise and the central air will then turn on again.

Figure 7:
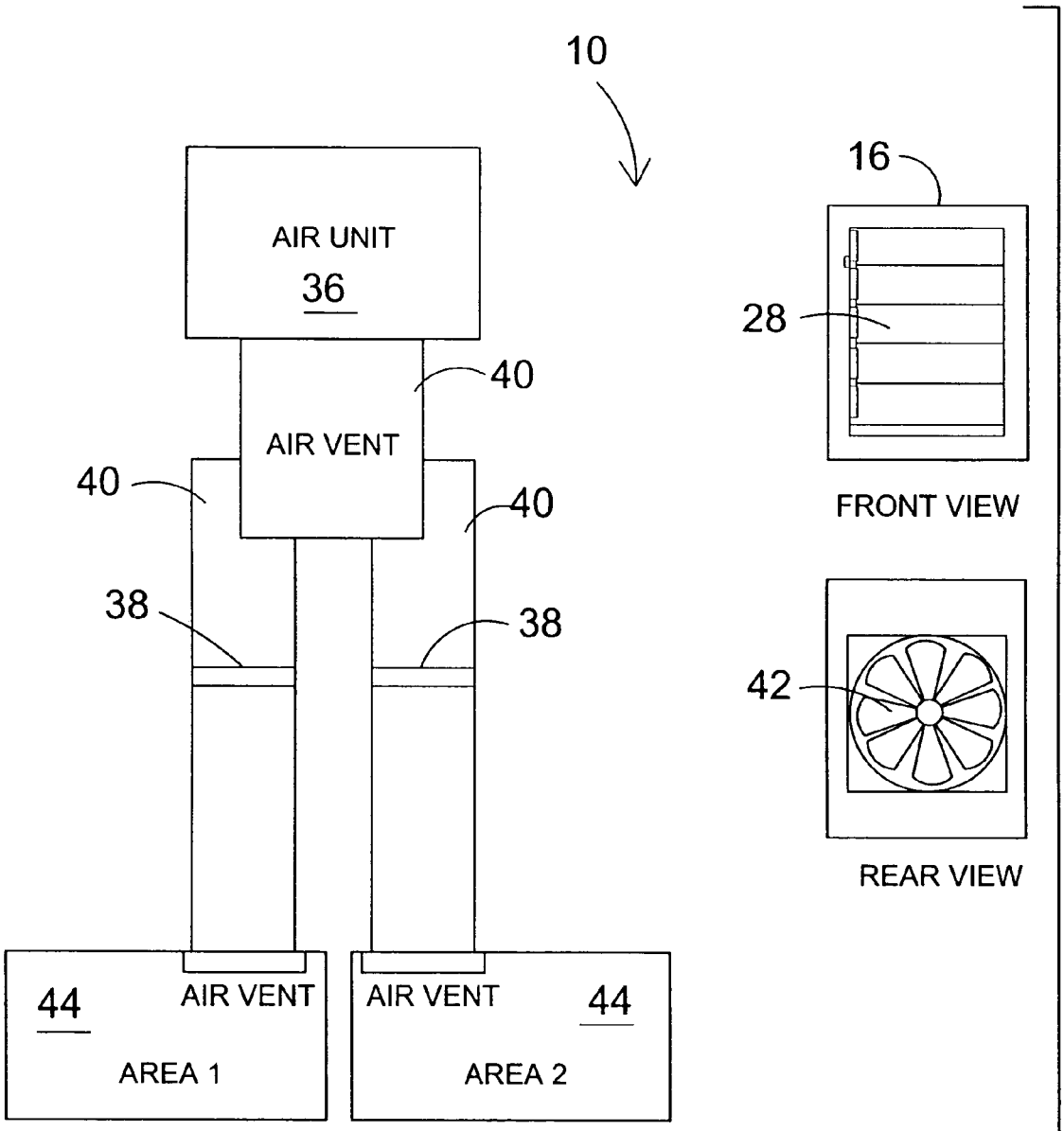
FIG. 7 is a flow chart of the present invention.

Turning to FIG. 7, shown therein is a flow chart of the present invention 10. This system 10 could be used on a larger scale such as large buildings like malls where many different air units 36 are required. Instead of having motorized vent openings, this modified version would have motorized vent flaps 38 inside of the air duct or vent 40. This would allow one air unit 36 to provide air to more than one area of the building, but allowing each area to have independent air temperatures. The system would work exactly the same way as the original version except now the motorized vents 38 are inside the ducts or vents 40. The areas (e.g., Area 1 and Area 2) would have their own thermostats and these thermostats would be connected to a main thermostat as previously disclosed. The independent thermostats would shut the vent 38 when the desired temperature is reached. Also shown are a fan 42, motorized vent 16 with louvers 28, and a non-motorized air vent 44.

I claim:

1. A method for controlling the air temperature of a building having a plurality of separate rooms and a central cooling system, the cooling system having a plurality of air ducts that deliver air to each of the rooms, comprising the steps of:

a) providing an air vent in each of the rooms of the building, the air vent having a plurality of louvers thereon wherein the louvers have a motorized controller wherein the louvers are opened in a first position, closed in a second position, or adjusted to any position between the first and second positions;

b) providing a main thermostat for controlling the operation of the central cooling system of the building, wherein the main thermostat will turn off the central cooling system when all of the rooms of the building reach a predetermined temperature and reopen all of said louvers in all of the rooms;

c) providing a room thermostat in each of the rooms of the building to permit the temperature of the room to be regulated, wherein each room thermostat is connected to each motorized controller of the air vent disposed in each room and to the main thermostat so that the louvers of the air vent can be adjusted to the first, second or in-between position by the room thermostat according to the temperature selected by the operator, and so that the room thermostat will signal the main thermostat when each room reaches the predetermined temperature so that the main thermostat will then turn off the central cooling system; and d) controlling said cooling system to deliver cooling air to the rooms at the lowest desired temperature setting picked out of all of the rooms.

2. The method of claim 1, further comprising the steps of providing an air vent having an electrical motor mounted thereon which motor controls the operation of the louvers through a mechanism having at least one gear for operating the louvers.

3. The method of claim 2, further comprising the steps of providing a plurality of gears through which gears the electrical motor controls the operation of the louvers, wherein at least one gear is mounted on the motor and at least one gear is mounted on each louver.

4. A method for controlling the air temperature of a building having a plurality of separate rooms and a central cooling system, the cooling system having a plurality of air ducts that deliver air to each of the rooms, the cooling system having an air vent in each room to which the air ducts are connected, comprising the steps of:

a) providing a motorized flap in each of the air ducts leading to each of the rooms of the building, the motorized flap having a plurality of louvers thereon, wherein the louvers have a motorized controller wherein the louvers are opened in a first position, closed in a second position, or adjusted to any position between the first and second position;

b) providing a main thermostat for controlling the operation of the central cooling system of the building, wherein the main thermostat will turn off the central cooling system when all of the rooms of the building reach a predetermined temperature and reopen all of said louvers in all of said air ducts;

c) providing a room thermostat in each of the rooms of the building to permit the temperature of the room to be regulated, wherein each room thermostat is connected to each motorized controller of the flap disposed in each air duct and to the main thermostat so that the louvers of the motorized flap can be adjusted to the first, second or in-between position by the room thermostat according to the temperature selected by the operator, and so that the room thermostat will signal the main thermostat when each room reaches the predetermined temperature so that the main thermostat will then turn off the central cooling system; and d) controlling said cooling system to deliver cooling air to the rooms at the lowest desired temperature setting picked out of all of the rooms.

5. The method of claim 4, further comprising the steps of providing a motorized flap having an electrical motor mounted thereon, which motor controls the operation of the louvers through a mechanism having at least one gear for operating the louvers.

6. The method of claim 5, further comprising the steps of providing a plurality of gears through which gears the electrical motor controls the operation of the louvers, wherein at least one gear is mounted on the motor and at least one gear is mounted on each louver.

* * * * *